United States Patent [19]

Paulus et al.

[11] 4,143,184

[45] Mar. 6, 1979

[54] PRODUCTION OF GALVANIZED STEEL STRIP

[75] Inventors: Philippe Paulus; Marios Economopoulos, both of Liege, Belgium

[73] Assignee: Centre de Recherche Metallurgiques-Centrum voor Research in de Metallurgie

[21] Appl. No.: 782,953

[22] Filed: Mar. 30, 1977

[30] Foreign Application Priority Data

Apr. 1, 1976 [BE] Belgium ..... 840316
Apr. 2, 1976 [BE] Belgium ..... 840373

[51] Int. Cl.[2] ..... C23C 1/02

[52] U.S. Cl. ..... 427/300; 427/321; 427/329; 427/309; 427/374 C; 427/433; 427/259; 148/153; 118/65; 118/69; 118/72

[58] Field of Search ..... 427/321, 300, 329, 309, 427/374 C, 433, 259; 148/153

[56] References Cited

U.S. PATENT DOCUMENTS

| | | | |
|---|---|---|---|
| 222,655 | 12/1879 | Breeding | 427/436 |
| 2,118,758 | 5/1938 | Crapo | 148/153 X |
| 3,010,844 | 11/1961 | Klein et al. | 427/321 |
| 3,383,250 | 5/1968 | Pierson et al. | 148/6.35 |

*Primary Examiner*—Ralph S. Kendall
*Attorney, Agent, or Firm*—Holman & Stern

[57] ABSTRACT

Steel strip is first heated to a predetermined temperature suitable for imparting desired properties to the strip and is then immersed in an aqueous bath maintained at substantially its boiling temperature. The composition of the aqueous bath is preferably adjusted to ensure the formation of an oxide film on the entire surface of the strip. After the strip has been withdrawn from the bath, oxide is eliminated from at least part of the surface of the strip, e.g., from one or both faces, by removal of the oxide or by reduction of the oxide. Simultaneously or subsequently, the strip is heated to a given temperature, e.g., 420°-550° C., maintained at this temperature, and immersed at this temperature in molten zinc.

20 Claims, 4 Drawing Figures

PRODUCTION OF GALVANIZED STEEL STRIP

The present invention relates to a method of producing galvanized steel strip and an installation for carrying out the method. The method uses hot-dip galvanizing in combination with heat treatment to produce, for example, strip for drawing or strip having a high limit of elasticity.

We have already suggested a process for heat-treating and galvanizing steel strip including immersion in molten zinc, comprising heating the strip to a temperature higher than its recrystallization temperature, immersing the strip in an aqueous bath maintained at substantially its boiling temperature, removing the strip from the bath, heating the strip to a temperature at which it can be immersed in the molten zinc and maintaining the strip at this temperature, and then immersing the strip at this temperature in the molten zinc.

This process makes it possible to produce galvanized strip generally having good properties of ductility, drawability, and elongation; but it is necessary to prevent the sheets emerging from the hot aqueous bath from becoming covered with an oxide film, since it is practically impossible to obtain a zinc coating adhering to such a film.

In contrast, in the present invention, we do not attempt to prevent steel oxidisation but rather we allow or even assist the formation of an oxide layer and then eliminate the troublesome layer before hot-dip galvanizing.

Accordingly, the present invention provides a method of galvanizing steel strip in which the strip is heated to a temperature suitable to give the strip the desired features, the strip is rapidly cooled by immersing it in an aqueous bath kept at its boiling temperature, and, after emergence from the aqueous bath, on the one hand, the oxide is removed from or reduced on the surface of the strip to be galvanized and, on the other hand, the strip is reheated to the immersion temperature in molten zinc, this temperature being kept until immersion in molten zinc is actually effected.

Eliminating oxide from only one face of the strip makes it possible to obtain strip galvanized on one side only.

Preferably, the composition of the aqueous bath is adjusted so as to ensure formation of a thin oxide layer (oxide film), e.g., less than 2 g/m$^2$, on the entire surface of the strip.

The oxide layer may be removed electrolytically. Electrolytic removal of oxide from only one face of the strip is possible because the electrolytic effect occurs only where the electric field is sufficient. In the case of removal of oxide by electrolysis, the strip is preferably subjected to a subsequent rinsing treatment before it is heated to the immersion temperature.

The oxide may be eliminated by reduction, which may be oxide effected by means of plasma torches producing a reducing gas. To prevent the temperature of the strip from exceeding the immersion temperature owing to heat produced by the plasma torches, a face of the strip is preferably subjected to a cooling treatment while the other is being de-oxidized. This cooling treatment can be carried out either by blowing a non-reducing gas onto the face to be cooled (which also makes it possible to prevent the reducing gas of the plasma torches from coming into contact with this face), or by contacting this face with a cooled roll or cylinder.

When producing full hard galvanized strip, the predetermined temperature to which the strip is heated to give the strip desired properties is lower than the recrystallization temperature and is preferably in the range 400° to 550° C.

In the case of the manufacture of galvanized strip for drawing or having a high limit of elasticity, the predetermined temperature to which the strip is heated to give it desired properties is higher than its recrystallization temperature. So far as galvanized strip for drawing is concerned, this predetermined temperature is in the range 650° to 850° C., preferably 700° to 800° C. So far as galvanized strip having a high limit of elasticity is concerned, this temperature is in the range 650° to 950° C, preferably 750° to 890° C.

Furthermore, in hot-dip galvanization, the strip should normally enter the zinc at a temperature substantially equal to or greater than the melting temperature of zinc, depending on the composition and temperature of the molten zinc. In the method of the invention, the immersion temperature is advantageously in the range 420° to 550° C., preferably 450° to 500° C.

In the case in which cooling in the aqueous bath has brought the strip down to substantially the temperature of the bath, e.g., a temperature of the order of 100° C, the heating before immersion in molten zinc should preferably be sufficiently rapid to ensure that the strip is above 300° C for longer than 30 seconds before immersion.

The present invention also relates to an installation for carrying out the above-described method.

The galvanization installation for treating steel strip, in particular for treating steel strip for drawing or having a high limit of elasticity, comprises a heating furnace for bringing the strip to a temperature suitable to give the strip desired properties and possibly for keeping it at that temperature for a predetermined time, a vessel containing an aqueous bath kept substantially at its boiling temperature, the strip being designed to be immersed in the bath to be rapidly cooled and possibly to be kept at the final cooling temperature for a predetermined time, means for removing or reducing a thin oxide layer formed after the strip has been immersed in the cooling aqueous bath, optionally means for bringing the strip thus cooled to the immersion temperature in molten zinc and, if necessary, for keeping the strip at that temperature until immersion actually takes place, a vessel containing molten zinc for galvanizing the strip by immersion, means for cooling the strip down to the ambient temperature, and means for unwinding the strip at the beginning of the treatment, and for winding the said strip at the end of the treatment.

When galvanization is effected on only one face of the sheet, the means for cooling the galvanized strip to ambient temperature are followed by means for successively pickling, rinsing, drying, and optionally oiling the non-galvanized face.

The oxide may be removed from at least one face of the strip in an electrolysis vessel. In that case, a rinsing vessel is optionally provided after the electrolysis vessel, and the means for heating the strip to the temperature of immersion in molten zinc may comprise a tempering furnace located after the rinsing vessel.

The invention will be described further, by way of example only, with reference to the accompanying drawings, in which:

FIG. 1 schematically shows a galvanization installation for steel strip, comprising electrolytic means for removing oxide from the strip;

Figure 1:
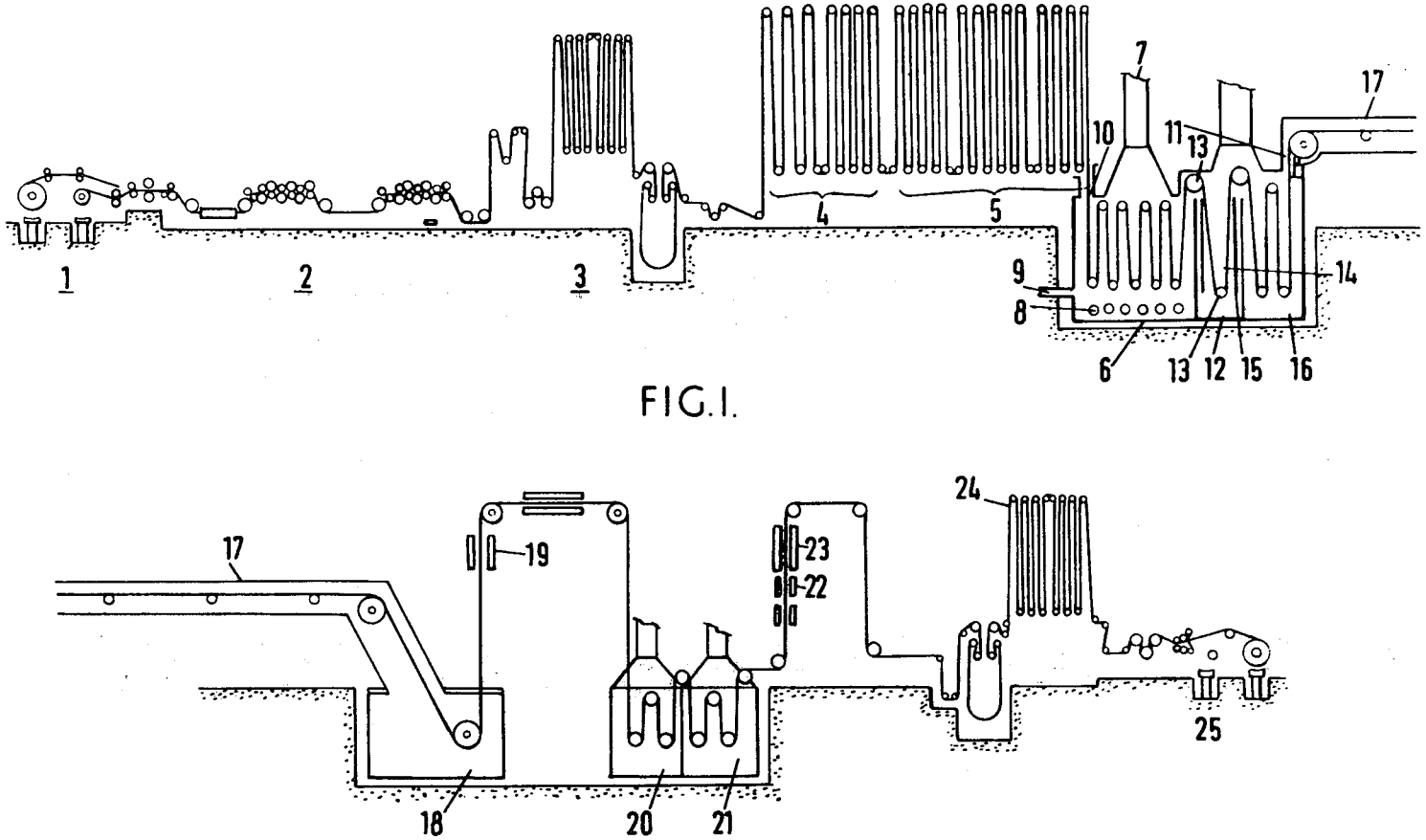

The installation shown in FIG. 1 comprises the following means:

(a) an input device 1 having an uncoiling machine and a welding machine;
(b) optionally, an electrolytic degreasing chamber 2 to remove rolling oils, if any;
(c) an input accumulator 3;
(d) a heating furnace 4 for heating the strip to a predetermined temperature, as explained above, for imparting desired properties to the strip;
(e) a chamber 5 for keeping the strip substantially at the predetermined temperature, chosen at a starting point for rapid cooling;
(f) a treatment station comprising a vessel 6 containing boiling water, a recovery device 7 located directly above the vessel 6 to condense steam, a water heater 8, a water supply inlet 9, an inlet lock 10, and an outlet lock 11;
(g) an electrolysis station for removing oxide, (electrolytic de-scaling) comprising a pickling vessel 12 containing an electrolyte 14, guide pulleys 13 for the strip electrodes 15 adapted to generate a sufficient electric field adjacent one face of the sheet to de-scale it;
(h) a cold rinsing vessel 16 immediately following the pickling vessel 12;
(i) an annealing furance 17 containing a non-oxidizing atmosphere, in which the strip is raised to a temperature in the range 400°-550° C. and held at this temperature;
(j) a galvanizing vessel 18 containing molten zinc;
(k) a final cooling zone 19;
(l) a pickling tank 20 and a rinsing tank 21, for removing oxide from the oxidised face to which zinc has not adhered;
(m) a drying device 22;
(n) optionally, a greasing device 23;
(o) an output accumulator 24;
(p) an output station 25 comprising a coiler and shears, and optionally a side shearing device, a flattening machine, a skin-pass device, and a conditioning line.

Figure 2:
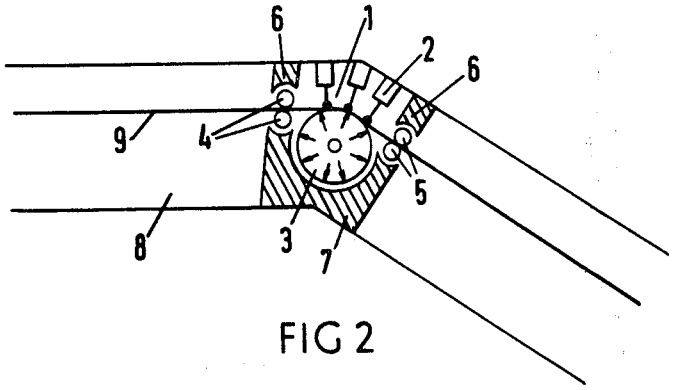
FIG. 2 is a diagrammatic section through apparatus for reducing oxide on one face of a steel strip by means of plasma torches, the other face being cooled by contact with a roll.

The oxide-reducing apparatus illustrated in FIG. 2, comprises a sealed chamber 1 containing plasma torches 2 and a cooled roll 3. The inlet and the outlet of the chamber 1 are each constituted by a pair of contiguous rollers 4, 5 between which the strip 9 passes. Partitions 6 define a compartment in which the plasma torches 2 are located; a partition 7 defines a compartment in which the cooled roll 3 is located and also defines a bearing seat for the roll. The roll 3 is a hollow cylinder pierced with holes and is supplied with a non-reducing coolant gas (nitrogen). The chamber 1 is located in an enclosure 8 extending from the outlet of the heat treatment zone to the vessel containing molten zinc. The strip 9 passes along the enclosure 8, passes between the rollers 4, enters the chamber 1, in which one of its faces is deoxidized under the effect of reducing gas emitted by the plasma torches 2, the other face being cooled by contact with the roll 3 and comes out from the chamber 1 by passing between rollers 5.

Figure 3:
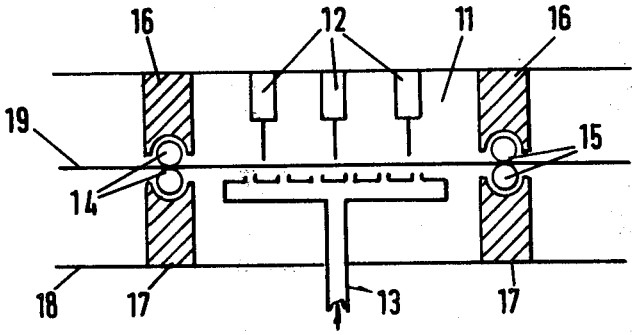
FIG. 3 is a diagrammatic section through another apparatus for reducing oxide on one face of a steel strip by means of plasma torches, the other face being cooled by blowing non-reducing gas onto it.

The oxide-reducing apparatus illustrated in FIG. 3 comprises a sealed chamber 11 containing plasma torches 12 and a device 13 for blowing non-reducing cooling gas. The inlet and outlet of the chamber 1 are each constituted by a pair of contiguous rollers 14, 15 between which the strip 19 passes. Partitions 16 and 17 define the compartments in which the plasma torches 12 and the cooling gas blowing device 13 are located. The chamber 1 is located in an enclosure 18 extending from the outlet of the heat treatment zone to the vessel containing molten zinc. The strip 19 passes along the enclosure 18, passes between the rollers 14, enters the chamber 11, in which one of its faces is deozidized under the effect of reducing gas emitted by the plasma torches 12, the other face being cooled by the action of the gas blowing device 13, and leaves the chamber 11 by passing between the rollers 15.

Figure 4:
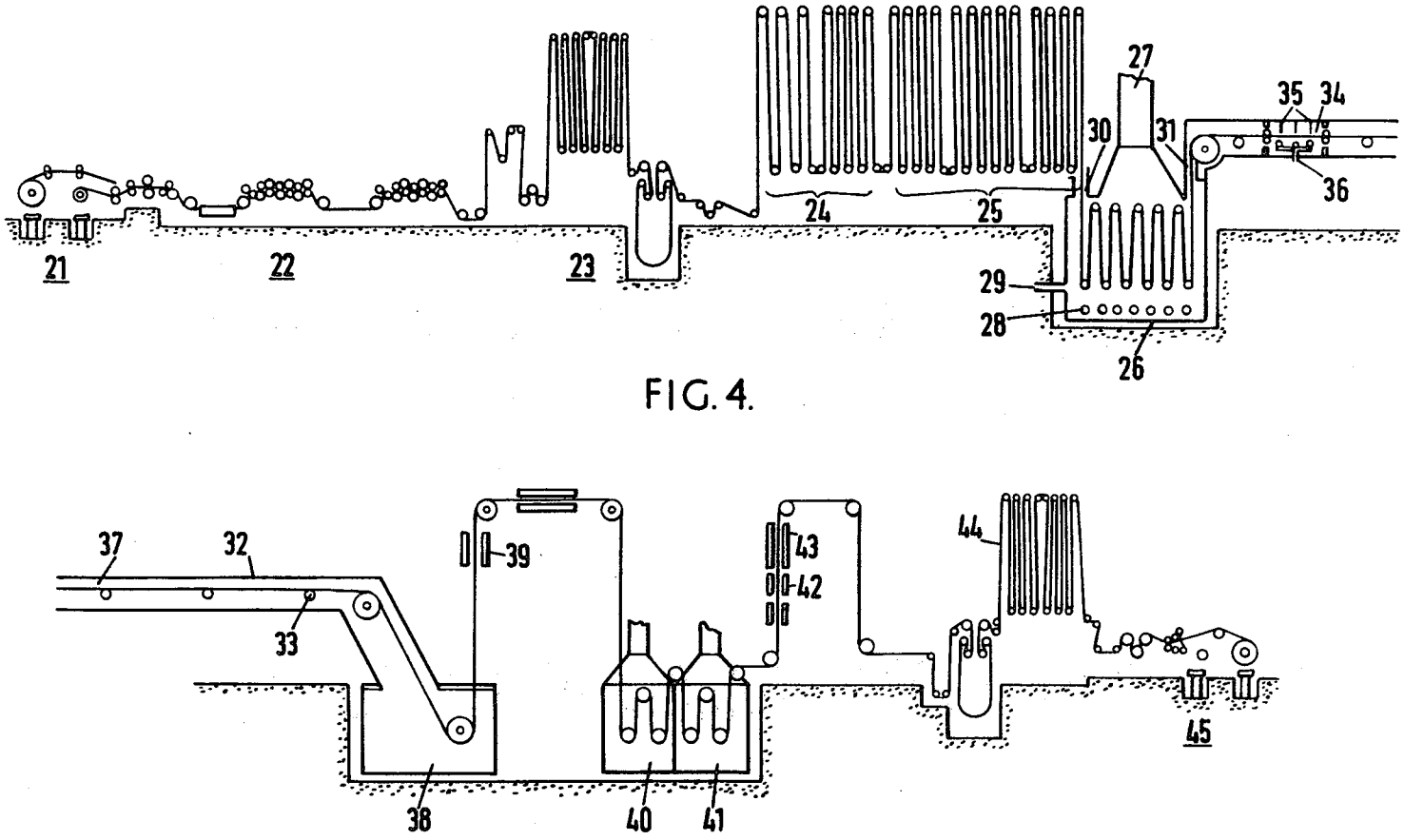
FIG. 4 shows a complete galvanization installation for steel strip, in which oxide is reduced by means of plasma torches.

FIG. 4 illustrates a galvanization installation which comprises the following means:

(a) an input device 21 having an uncoiling machine and a welding machine;
(b) optionally, an electrolytic degreasing chamber 22 for removing rolling oil, if any;
(c) an input accumulator 23;
(d) a heating furnace 24 for heating the strip to a predetermined temperature for imparting desired properties to the strip;
(e) a chamber 25 for keeping the strip substantially at the predetermined temperature, chosen as a starting point for rapid cooling;
(f) a treatment station comprising a vessel 26 containing boiling water, a device 27 for recovering steam by condensation located directly above the vessel 26, a water heater 28, a water supply inlet 29, an inlet lock 30, and an outlet lock 31;
(g) an enclosure 32 extending from the outlet of the treatment vessel 26 to a galvanizing station, the enclosure 32 containing guide rollers 33 for the strip, a sealed chamber 34 in which plasma torches 35 and a cooling gas blowing device 36 are located, and a zone 37 for additional heating to the temperature of immersion in molten zinc and for keeping this temperature until immersion actually takes place, the immersion temperature being in the range 420°-550° C;
(h) a galvanizing vessel 38 containing molten zinc;
(i) a final cooling zone 39;
(j) a pickling tank 40 and a rinsing tank 41, for removing oxide;
(k) from the oxidized face to which zinc has not adhered;
(l) a drying device 42;
(m) optionally, a greasing device 43;
(n) an output accumulator 44;
(o) an output station 45 comprising shears and a coiler, and optionally a side shearing device, a flattening machine, a skin-pass machine, and a conditioning line.

We claim:

1. In a method of continuously galvanizing thin steel strip, comprising the following successive steps:

(a) preheating the strip to a temperature suitable for imparting desired mechanical properties to the strip, (b) adjusting the temperature of the strip, under a protective atmosphere, to a level suitable for its immersion in molten zinc, (c) immersing the temperature-adjusted strip from step (b) into a bath of molten zinc, (d) draining the molten zinc from the strip, and (e) cooling the resulting strip, the improvement which consists of:

selecting the preheating temperature in the range of from 400° to 950° C. in step (a), and performing the temperature adjustment step of step (b) in the following manner:

(1) quenching the strip in an aqueous bath maintained substantially at its boiling temperature and removing the strip from the bath, in order to form on the strip a continuous oxide layer less than 2 $g/m^2$ thick, (2) eliminating the oxide layer formed on at least a part of the surface of the strip, and (3) selecting the said suitable level in the range of from 420° to 550° C. and maintaining this temperature.

2. A method as claimed in claim 1 in which oxide is eliminated from only one face of the strip.

3. A method as claimed in claim 1, in which the elimination of oxide comprises removing the oxide from the strip.

4. A method as claimed in claim 3, in which the oxide is removed electrolytically.

5. A method as claimed in claim 4, including rinsing the strip after the electrolytic removal of the oxide.

6. A method as claimed in claim 5, in which the heating of the strip to the immersion temperature is effected after the rinsing of the strip.

7. A method as claimed in claim 1, in which the elimination of the oxide comprises reducing the oxide.

8. A method as claimed in claim 7, in which the reduction of the oxide is carried out by means of plasma torches producing a reducing gas.

9. A method as claimed in claim 8, in which one face of the strip is subjected to the action of the plasma torches, and the other face is subjected to cooling.

10. A method as claimed in claim 9, in which the cooling comprises contacting the said other face with a cooled roll.

11. A method as claimed in claim 1, for the production of full hard galvanized strip, in which the said predetermined temperature is lower than the recrystallization temperature.

12. A method as claimed in claim 11, in which the said predetermined temperature is in the range 400° to 550° C.

13. A method as claimed in claim 1 for the production of galvanized strip for drawing or having a high limit of elasticity in which, the said predetermined temperature is higher than the recrystallization temperature.

14. A method as claimed in claim 13, for the production of galvanized strip for drawing, in which the said predetermined temperature higher than the recrystallization temperature is in the range 650° to 850° C.

15. A method as claimed in claim 14, in which the said predetermined temperature is in the range 700° to 800° C.

16. A method as claimed in claim 13, for the production of galvanized strip having a high strength, in which the said predetermined temperature higher than the recrystallization temperature is in the range 650° to 950° C.

17. A method as claimed in claim 16, in which the said predetermined temperature is in the range 750° to 890° C.

18. A method as claimed in claim 1, in which the said immersion temperature is in the range 420° to 550° C.

19. A method as claimed in claim 18, in which the heating temperature is in the range 450° to 500° C.

20. A method as claimed in claim 1, in which the strip is substantially at the temperature of the aqueous bath when withdrawn from the bath, and between withdrawal from the aqueous bath and immersion in the molten zinc the strip is above 300° C. for longer than 30 seconds.

* * * * *